US006102253A

United States Patent [19]

Gallina et al.

[11] Patent Number: 6,102,253

[45] Date of Patent: Aug. 15, 2000

[54] METERING DISPENSER FOR SOAP POWDER

[75] Inventors: Ferenc Gallina, Bötzingen; Jan Willem Staben, Staufen, both of Germany

[73] Assignee: Hirtler GmbH, Heitersheim, Germany

[21] Appl. No.: 09/180,096

[22] PCT Filed: May 23, 1997

[86] PCT No.: PCT/EP97/02655

§ 371 Date: Nov. 2, 1998

§ 102(e) Date: Nov. 2, 1998

[87] PCT Pub. No.: WO97/45048

PCT Pub. Date: Dec. 4, 1997

[30] Foreign Application Priority Data

May 24, 1996 [DE] Germany ..... 296 09 312 U
Oct. 12, 1996 [DE] Germany ..... 296 17 516 U

[51] Int. Cl.[7] ..... B67D 5/06

[52] U.S. Cl. ..... 222/181.3; 222/365

[58] Field of Search ..... 222/180, 181.1, 222/181.3, 185.1, 365, 196, 345, 349

[56] References Cited

U.S. PATENT DOCUMENTS

| | | | |
|---|---|---|---|
| 579,954 | 4/1897 | Case | 222/365 |
| 1,095,542 | 5/1914 | Bacon | 222/365 |
| 1,208,784 | 12/1916 | Holmes | 222/365 |
| 1,497,716 | 6/1924 | Fawcett . | |
| 1,558,275 | 10/1925 | Peterson et al. . | |
| 1,635,139 | 7/1927 | Neckles . | |
| 1,796,086 | 3/1931 | Davis | 222/365 |
| 1,993,401 | 3/1935 | Dudley . | |
| 2,122,216 | 6/1938 | Seawell | 222/365 |
| 2,578,010 | 12/1951 | Llorens | 222/365 |
| 2,607,514 | 8/1952 | Keene, Jr. | 222/230 |
| 2,681,169 | 6/1954 | Watson | 222/162 |
| 2,730,271 | 1/1956 | Dunn | 222/322 |
| 2,987,224 | 6/1961 | Chapman | 222/365 |
| 5,437,396 | 8/1995 | Russillo et al. | 222/365 |

FOREIGN PATENT DOCUMENTS

| | | | |
|---|---|---|---|
| 934501 | 5/1948 | France | 9/1 |
| 81356 | 7/1894 | Germany . | |
| 188400 | 8/1906 | Germany . | |
| 445408 | 6/1927 | Germany . | |
| 1283470 | 11/1968 | Germany . | |
| 1779727 | 9/1971 | Germany | A47K 5/10 |
| 2646882 | 4/1977 | Germany | A47K 5/10 |
| 3511507 | 10/1986 | Germany | G01F 11/12 |
| 414966 | 12/1966 | Switzerland | A47G 19/24 |
| 443588 | 2/1968 | Switzerland | A47G 19/24 |

OTHER PUBLICATIONS

Derwent Abstract of DE 3511507 (Oct. 9, 1986).
Derwent Abstract of DE 1779727 (Mar. 24, 1977).

*Primary Examiner*—Andres Kashnikow
*Assistant Examiner*—Jorge Bocanegra
*Attorney, Agent, or Firm*—Norris, McLauhglin & Marcus, P.A.

[57] ABSTRACT

Powdered-soap dispenser for sprinkling powdered soap or the like onto the hand in an apportioned manner, comprising a dispenser part (1), a container (2) and a mount (3), it being possible for the dispenser part (1) to be integrated in the container (2) or to be separable, characterized in that the dispenser part (1) has at least one sprinkling hole (6), in that the dispenser part (1) has an apportioning lever (4) which has an actuating surface (10) and at least one apportioning closure piston (11), the apportioning closure pistons (11) projecting through the sprinkling holes (6) into the interior of the container (2), in that the sprinkling holes (6) are open at the top and closed at the bottom in the basic position of the apportioning lever (4) and, following actuation of the apportioning lever (4), are closed at the top and open at the bottom in the dispensing position, it being the case that, in the direction towards the interior of the container (2), the apportioning closure piston (11) has integrally formed on it a web (15) and, following this, a closure part (8) which, on the side located on the web (15), is of spherical or conical shape and, in the dispensing position, closes the sprinkling holes (6) from the inside, and in that the apportioning lever (4) has an integrally formed restoring spring (5).

13 Claims, 8 Drawing Sheets

METERING DISPENSER FOR SOAP POWDER

Figure 1:
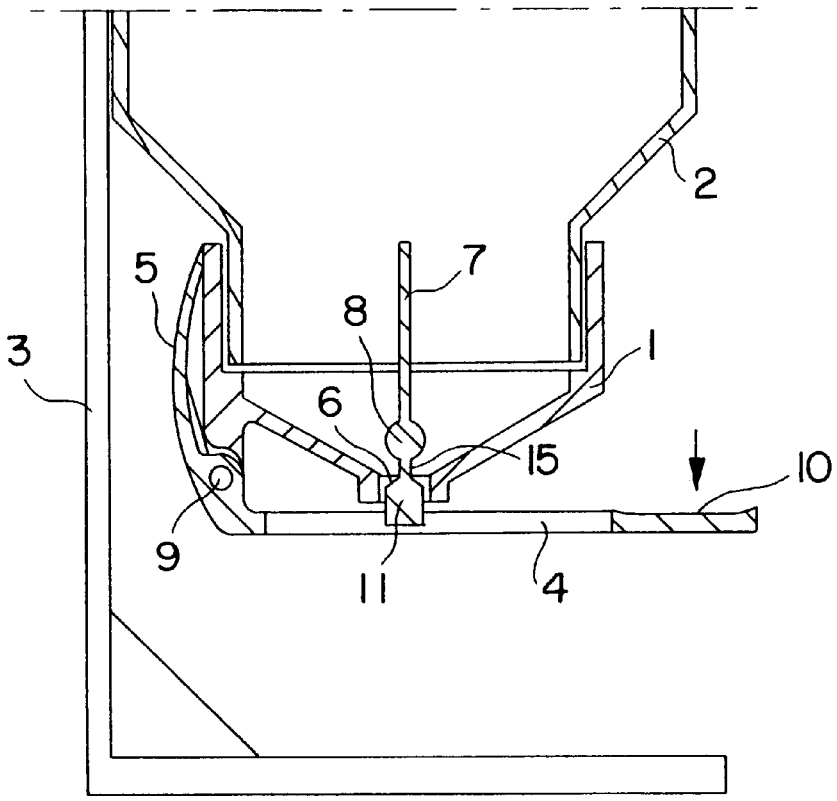

The invention relates to powdered-soap dispensers for sprinkling powdered soap or the like onto the hand in an apportioned manner.

For reasons of hygiene, instead of bars of soap, use is often made of liquid soap from various designs of liquid-soap dispensers. In washrooms in the workplace and public places, the use of liquid-soap dispensers is customary since regulations prohibit the use of bars of soap. Occasionally, use is also made of devices for scraping off fragments from a piece of soap, as a result of which contact of the piece of soap with the hand is ruled out.

As a result of the more favourable properties, for example the ability to break down readily, it would be preferable to use powdered soap; however, there is an apparent lack of practical dispensers which can be produced cost-effectively for this purpose. The use of powdered soap would also be recommendable because, in recent years, new production methods have improved the properties of powdered soap, in particular the sprinkling characteristics thereof.

The hitherto known designs according to U.S. Pat. No. 2,681,169, FR 934 501, DE 17 79 727 and DE 26 46 882 are dispensers, but not of the apportioning variety, i.e. upon actuation a closure is opened and powdered soap runs out until the opening is closed. High outlay is often required here in order to prevent bridge formation of the powdered soap. The designs are complicated and expensive.

The design according to DE 35 11 507 is suitable for dispensing relatively large quantities in an apportioned manner and is intended for washing powder for washing machines. A disadvantage of the design is that, as the closing piston is lifted from the bottom position into the top position, both openings are open, as a result of which apportioning is inaccurate and it is not possible for small quantities to be apportioned.

The object of the invention was to provide a powdered-soap dispenser which does not have the listed disadvantages of the prior art and is just as straightforward to handle as the known dispensers for liquid soap.

This object is achieved by a novel powdered-soap dispenser for sprinkling powdered soap or the like onto the hand in an apportioned manner which comprises a dispenser part, a container and a mount, it being possible for the dispenser part to be integrated in the container or to be separable.

The dispenser part has at least one sprinkling hole, as well as an apportioning lever. For its part, the apportioning lever has an actuating surface and at least one apportioning closure piston.

The apportioning closure pistons project through the sprinkling holes into the interior of the container. Furthermore, in the direction towards the interior of the container, the apportioning closure piston has integrally formed on it a web, and, following this, a closure part, it being the case that the closure part, on the side located on the web, is of spherical or conical shape and, in the dispensing position, the closure part closes the sprinkling holes from the inside. This produces, between the apportioning closure piston and closure part, a cavity which determines the volume of powdered soap which is to be dispensed when the dispenser is actuated. Accordingly, the wall height of the sprinkling holes is also derived from the volume of the cavity.

Finally, the apportioning lever has an integrally formed restoring spring.

The sprinkling holes are open at the top and closed at the bottom in the basic position of the apportioning lever and, following actuation of the apportioning lever, are closed at the top and open at the bottom in the dispensing position.

The actuating surface on the apportioning lever is preferably arranged such that, when the dispenser is actuated by the thumb or fingers of one hand, the powdered soap which is to be apportioned falls onto the palm of the same hand.

The diameters of the apportioning closure pistons are usually greater than the diameter of the sprinkling holes, in order to ensure closure of the sprinkling holes in the basic position.

In one advantageous embodiment, the diameter of the apportioning closure piston is smaller than the diameter of the sprinkling holes, although the gap between the apportioning closure piston and sprinkling holes is so small that, as a result of internal friction in the powdered soap, no powdered soap falls through.

In a further advantageous embodiment, elevations are integrally formed on the closure part.

In a further advantageous embodiment, the apportioning lever is mounted in an inherently resilient manner on the basic body or on the mount such that it can be rotated at a pivot point.

As the mount, which is preferably of L-shaped design, standing feet are advantageously integrally formed on the basic body.

Finally, the apportioning closure pistons may be seated on webs which are integrally formed on the apportioning lever and have surfaces which slope down obliquely.

In a second embodiment of the powdered-soap dispenser for sprinkling powdered soap in an apportioned manner, the dispenser part, once again, has at least one sprinkling hole. In this case, the diameter of the apportioning closure piston is smaller than the diameter of the sprinkling holes, the gap between the apportioning closure piston and sprinkling holes being so small that, as a result of internal friction in the powdered soap, no powdered soap falls through.

For this purpose, in one advantageous embodiment, a closure surface which slopes down obliquely in conical form is provided all the way around the apportioning closure piston, the external dimension at the bottom being greater than the internal dimension of the sprinkling holes. In the basic position, the closure surface butts against the sprinkling hole.

In a further advantageous embodiment, the apportioning closure piston is formed such that it is centred in the sprinkling hole, in particular, by means of centring webs, in order that the gap between the apportioning closure piston and sprinkling hole is uniform all the way around.

In a further advantageous embodiment, the apportioning closure piston is of tongue-like form.

Advantageously, the surfaces of the apportioning closure pistons and of the sprinkling holes are roughened.

In a further advantageous embodiment, the apportioning closure piston has extensions at the top.

The powdered-soap dispenser according to the invention is extremely suitable for the purpose of achieving the set object. It is just as straightforward to handle as the known dispensers for liquid soap. Upon actuation, the powdered-soap dispenser sprinkles a specific, relatively small quantity of powdered soap onto the hand actuating it. It is irrelevant here whether the container which contains the powdered soap is refillable or can be exchanged for a full container.

The mount can be designed as in the case of the known dispensers for liquid soap or such that the dispenser can stand on a surface.

In summary, the advantages achieved by the invention are to be seen in the fact that the design, rather than just permitting powdered soap to be apportioned, also allows the latter to be sprinkled over a surface area, comprises a small number of straightforward parts and can be produced cost-effectively.

Figure 2:
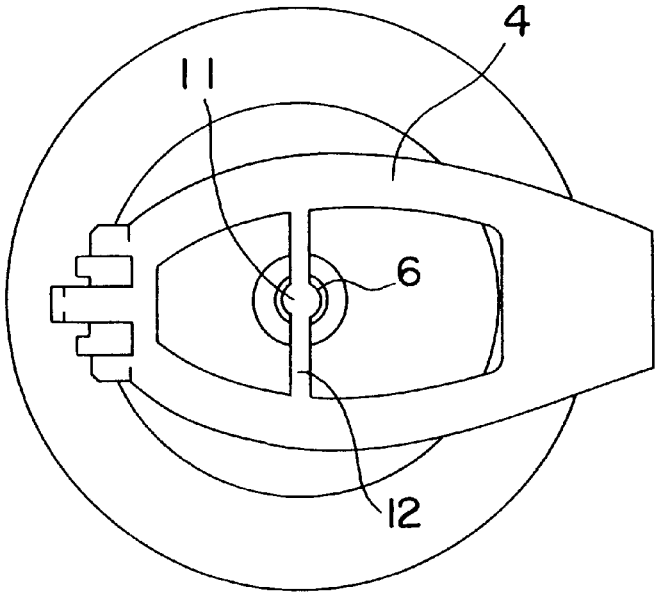
Figure 3:
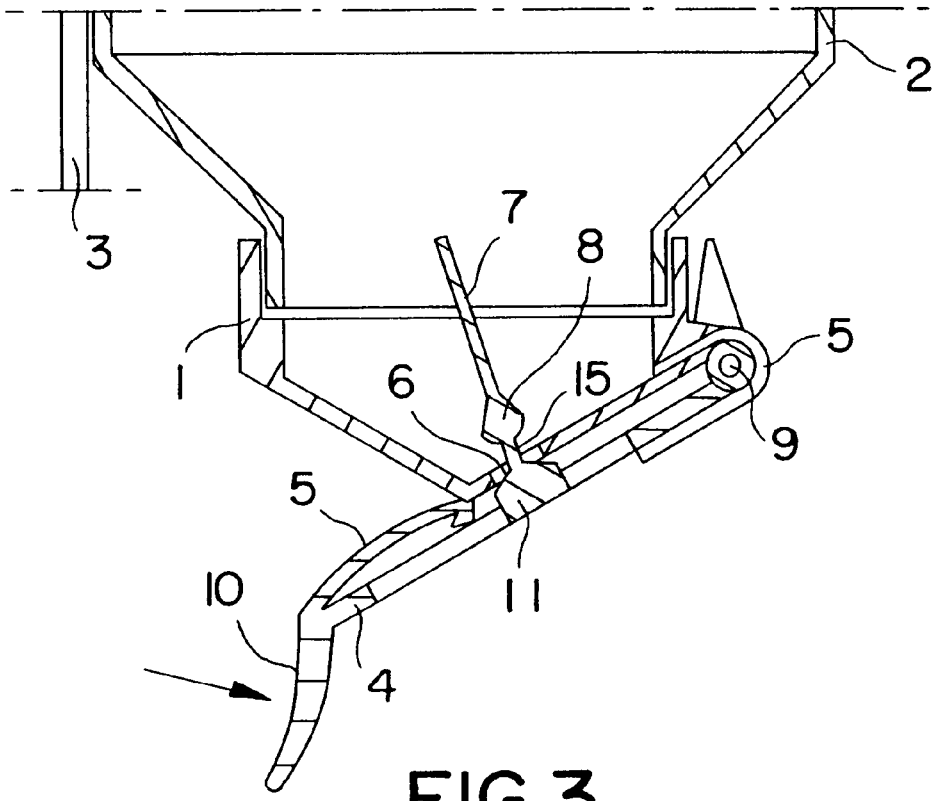
Figure 4:
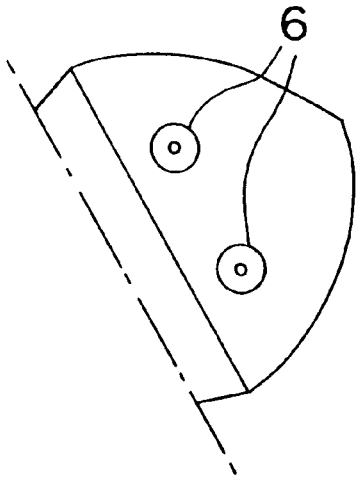
Figure 6:
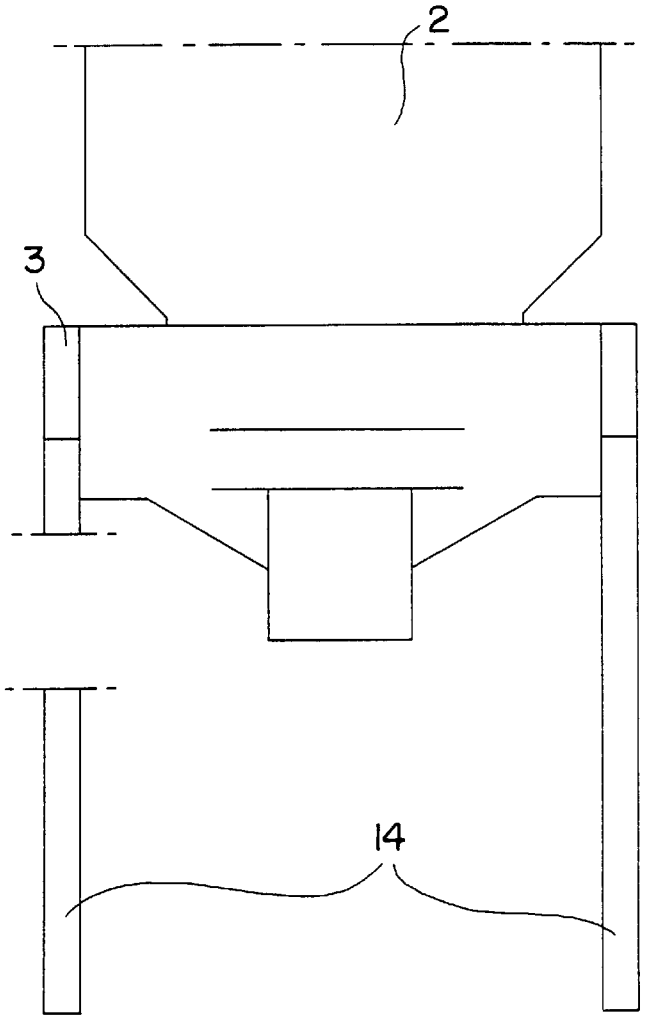
Figure 5:
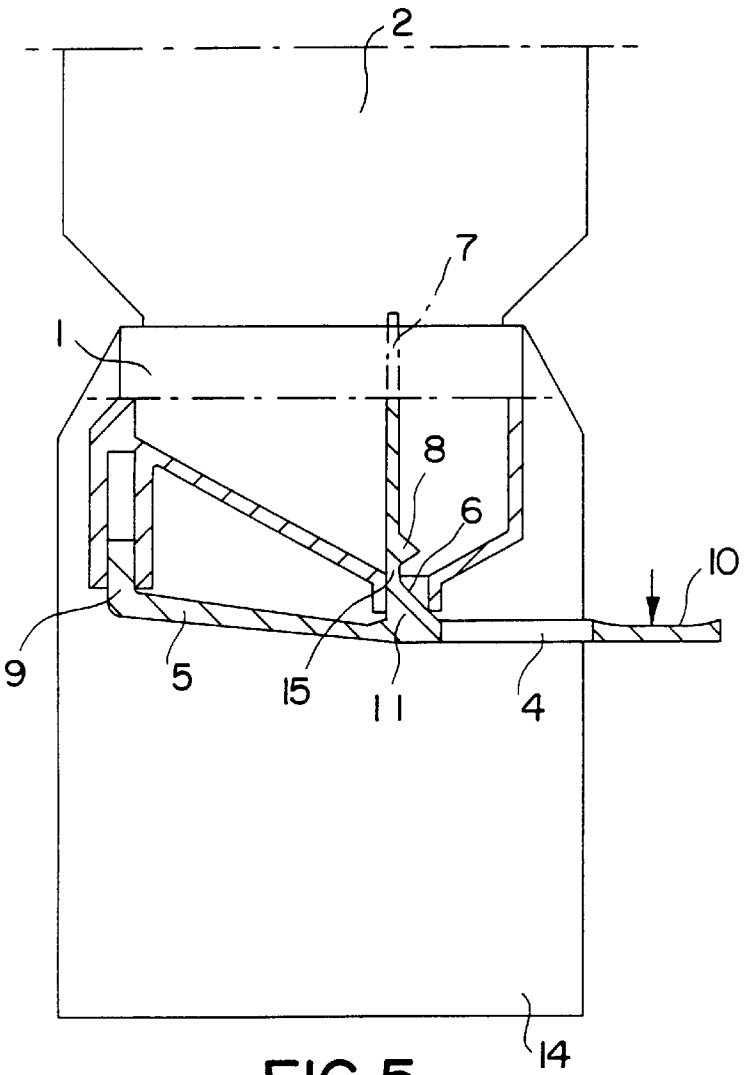
Figure 7:
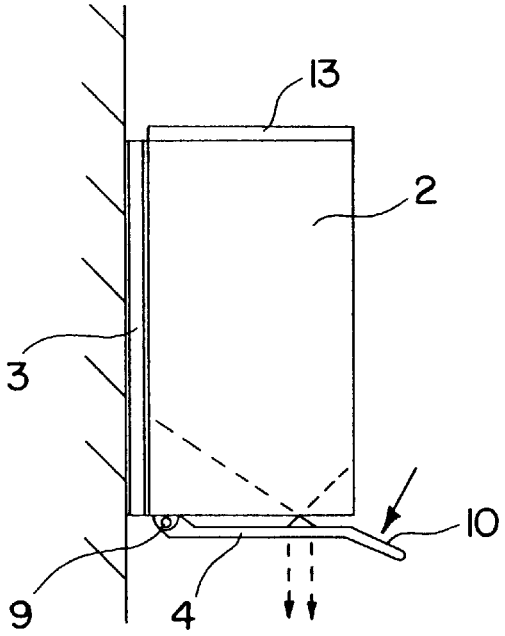
Figure 8:
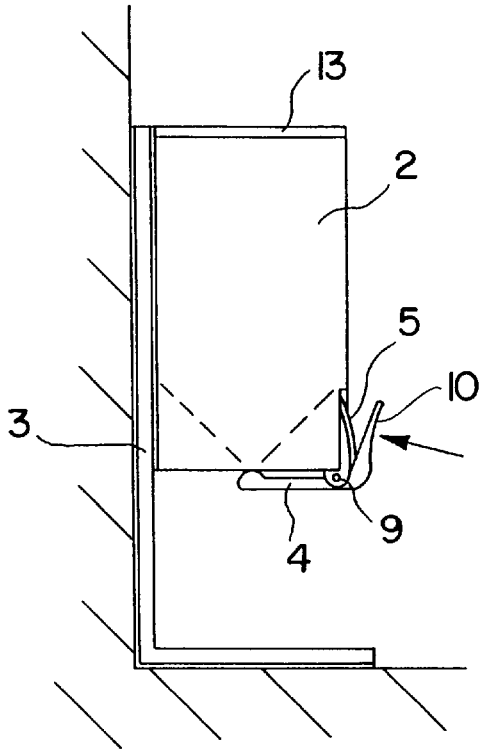

Without aiming to limit the invention unnecessarily, the invention is explained hereinbelow, by way of example, with reference to drawings, in which:

FIG. 1 shows the longitudinal section through a powdered-soap dispenser, actuation being from above and the apportioning-closure-piston diameter being smaller than the sprinkling-hole diameter, FIG. 2 shows the view of the dispenser from beneath, FIG. 3 shows the longitudinal section through a powdered-soap dispenser, actuation being from the rear and the apportioning-closure-piston diameter being greater than the sprinkling-hole diameter, FIG. 4 shows the view of part of the base of the dispenser part from the inside, FIG. 5 shows the longitudinal section through a powdered-soap dispenser with resilient apportioning lever and, as mount, standing feet integrally formed on the dispenser part, FIG. 6 shows a view from the rear of the dispenser according to FIG. 5, FIG. 7 shows, on a reduced scale, the side view of a powdered-soap dispenser with a wall-fastening mount, actuation being from above, and FIG. 8 shows, on a reduced scale, the side view of a powdered-soap dispenser with a wall/stand mount, actuation being from the front.

Figure 9:
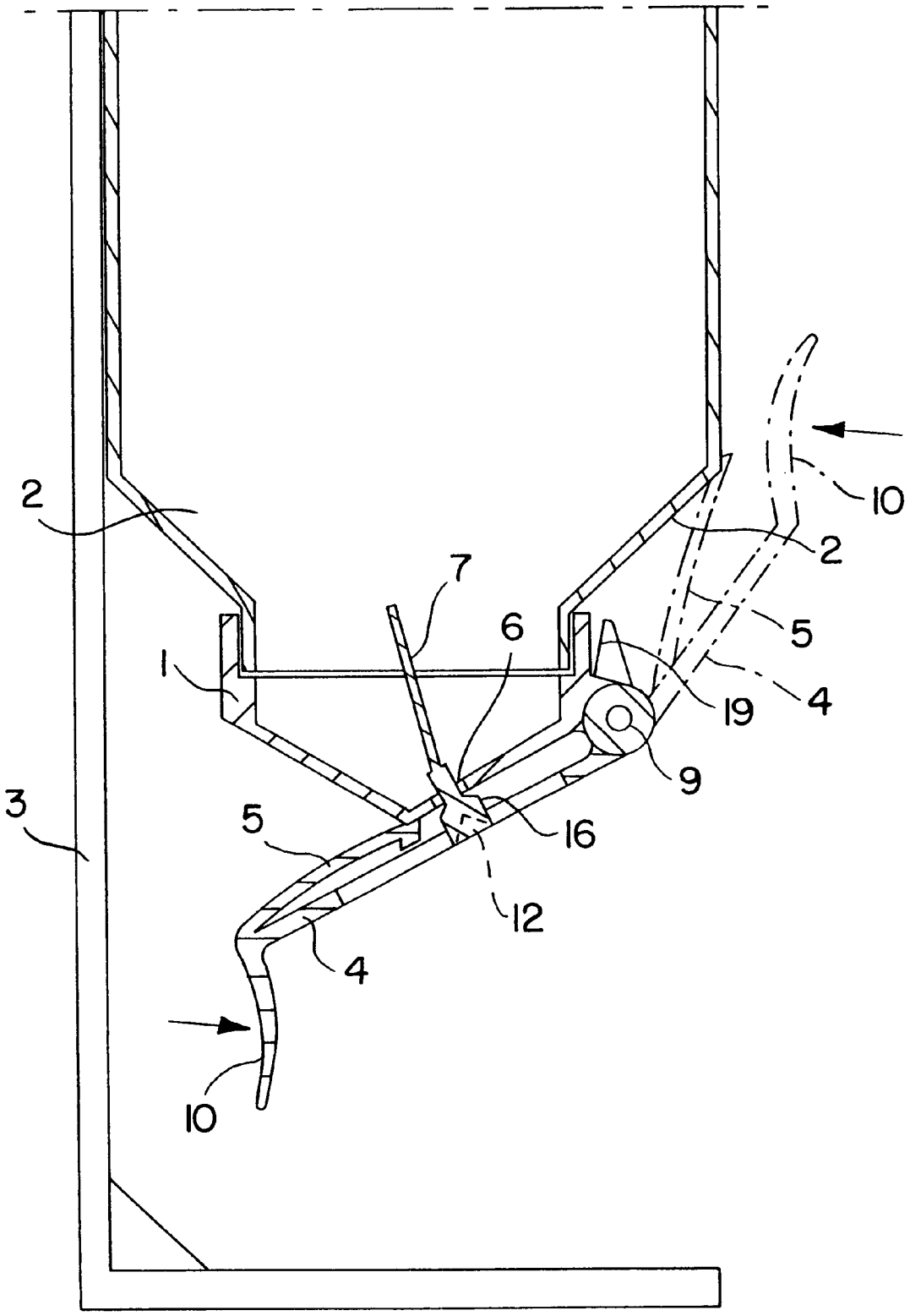
Figure 10:
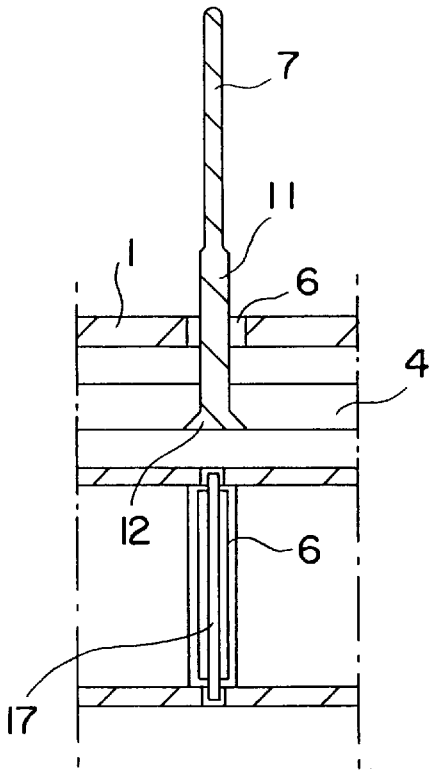
Figure 11:
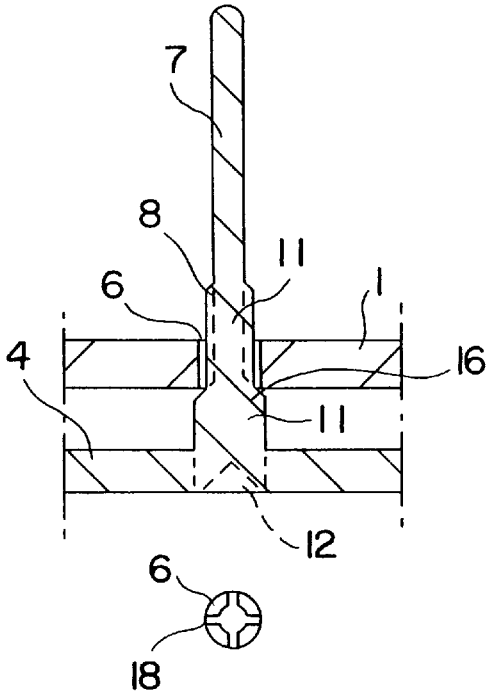
Figure 12:
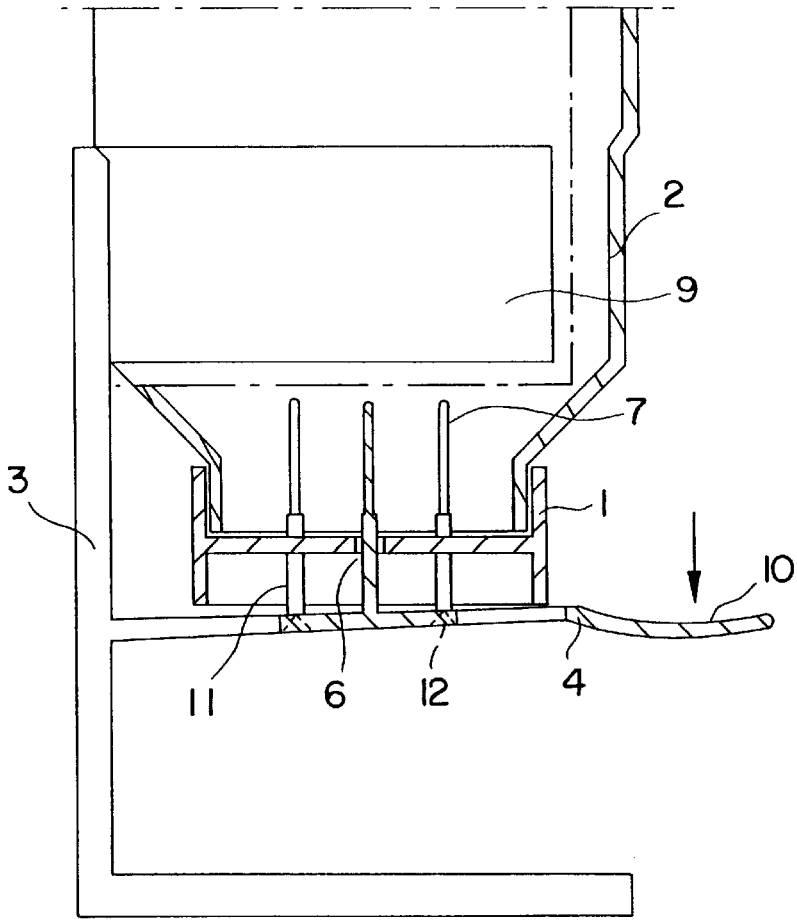
Figure 13:
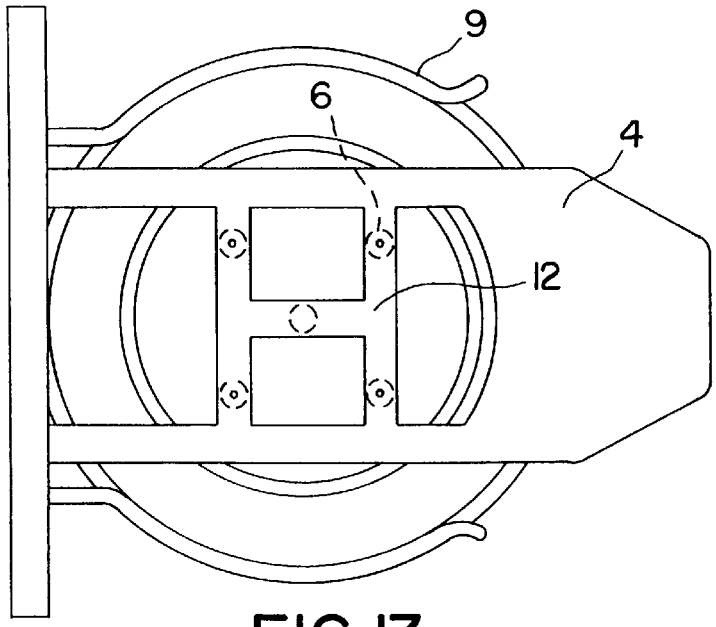
Figure 14:
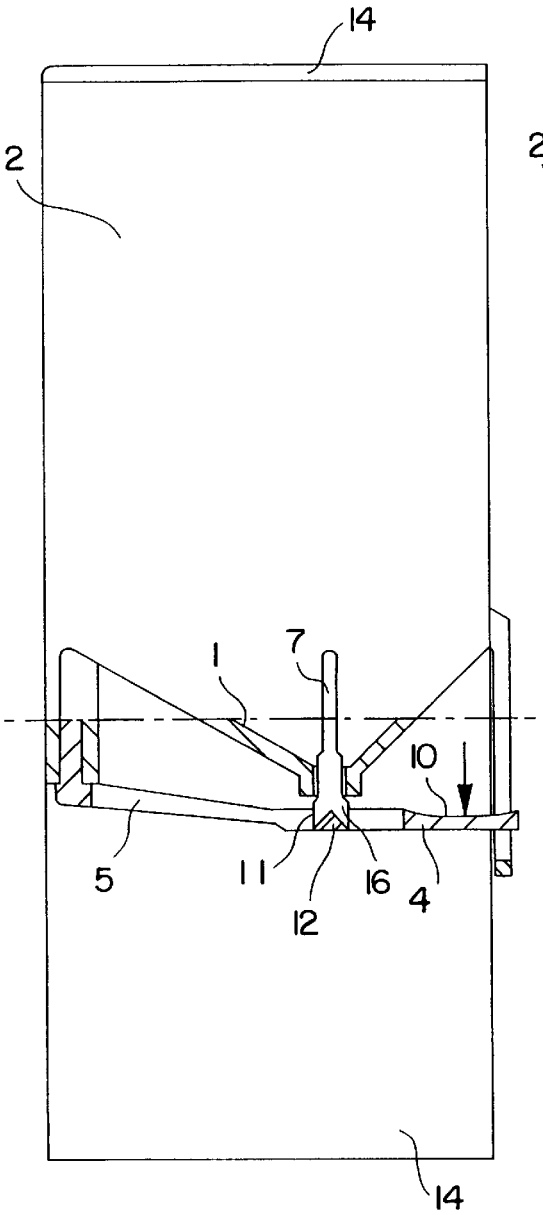
Figure 15:
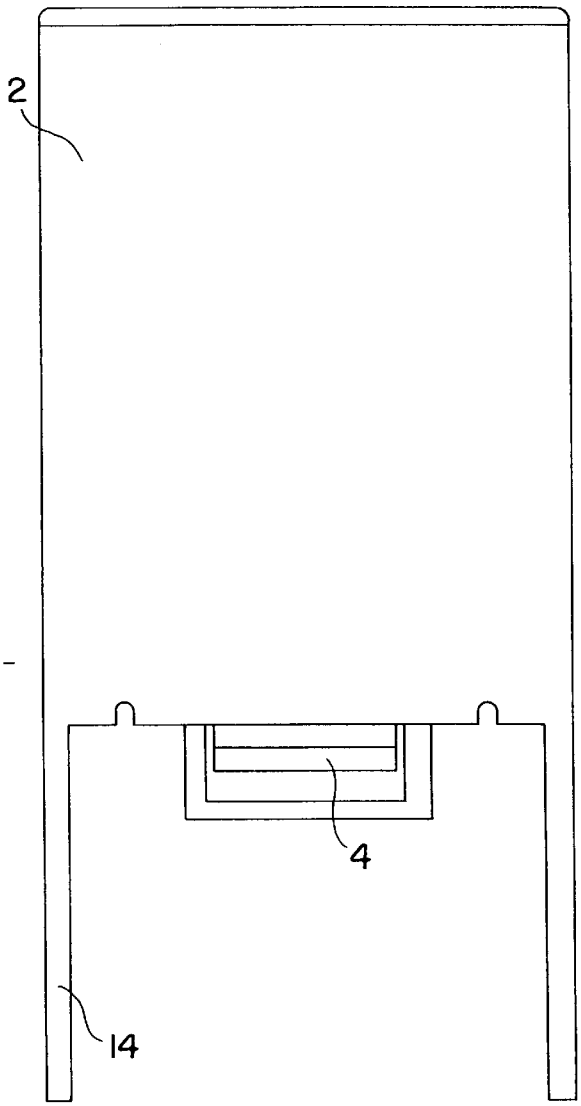

Without aiming to limit the invention unnecessarily, the second embodiment of the dispenser according to the invention is to be explained, by way of example, with reference to Drawings 9 to 15, in which:

FIG. 9 shows the longitudinal section through a powdered-soap dispenser, actuation being from the rear by pulling or from the front by pushing, FIG. 10 shows the longitudinal section through a tongue-like apportioning closure piston without a closure surface, with a view from above, FIG. 11 shows the longitudinal section through an apportioning closure piston with centring webs and closure surface, with a view from above, FIG. 12 shows the longitudinal section through a dispenser with exchangeable container, FIG. 13 shows the view from beneath of the dispenser according to FIG. 12, FIG. 14 shows the longitudinal section through a dispenser with actuation from the front and above, and FIG. 15 shows, in a view from the rear, the dispenser according to FIG. 14 with three sprinkling holes or a transversely located tongue-like apportioning closure piston.

FIGS. 1 to 8 illustrate powdered-soap dispensers which, in their basic construction, comprise a dispenser part (1) with the apportioning lever (4), the container (2) and the mount (3). The dispenser part (1) has one or more sprinkling holes (6). The apportioning lever (4) has as many apportioning closure pistons (11) as the dispenser part (1) has sprinkling holes (6).

That surface of the apportioning closure pistons (11) which is located in the sprinkling holes is of conical or spherical design and, in the basic position of the dispenser, closes the sprinkling holes (6) from beneath. Positioned on this surface is a web (15), and seated on this web (15) is a closure part (8) which, following actuation of the apportioning lever (4), closes the sprinkling holes (6) from above in the dispensing position, while at the same time the apportioning closure piston (11) opens the sprinkling holes (6) at the bottom. The powdered soap which is located in the cavity formed between the apportioning closure piston (11) and closure part (8) can thus fall downwards out of the container.

It is possible for the diameter of the apportioning closure piston (11) to be slightly smaller than the diameter of the sprinkling holes (6).

The diameter of the closure part (8) is smaller than the diameter of the associated sprinkling hole (6). Furthermore, rod-like elevations (7) are integrally formed on the closure part (8), these elevations, during dispenser actuation, moving in the container with the powdered soap and preventing bridge formation of the powdered soap.

In order that the powdered soap can fall freely downwards, the apportioning closure pistons (11) are advantageously seated on webs (12) which, at the top, have surfaces which slope down obliquely.

The apportioning lever (4) is moved into the basic position by an attached or integrally formed restoring spring (5). This integrally formed restoring spring may also be formed by the apportioning lever (4) being of inherently resilient configuration. Finally, the apportioning lever (4) is retained on the basic body (1) or on the mount (3).

The actuating surface (10) on the apportioning lever (4) is arranged such that it can be pushed by the thumb or alternatively pulled or pushed by the finger and the palm of the hand actuating it is thus inevitably located beneath the sprinkling holes (6).

Accordingly, the pivot point of the pivotable apportioning lever (4) is located between the actuating surface (10) and the apportioning closure piston (11) or at the end located opposite the actuating surface (10).

A preferred variant of the design according to the invention provides that, as the mount (1), standing feet (14) are integrally formed on the dispenser part (1), and the actuating surface (10) of the apportioning lever (4) is located at the top.

In the design which is suitable for refilling, the container (2) is designed with a cover (13) at the top.

FIGS. 9 to 15 illustrate dispensers which are intended for powdered soap or the like and, in their basic construction, comprise a dispenser part (1), the apportioning lever (4), the container (2) and the mount (3).

The dispenser part (1) and container (2) may form a single part. Furthermore, it is also possible for the mount (3) to be integrally formed thereon as a stand and/or wall mount.

It is possible for the dispenser part (1), as illustrated in FIGS. 9 and 12, to form the closure cover of the container (2) which has the opening directed downwards or, as is illustrated in FIGS. 14 and 15, to be integrated in the base of the container (2).

The dispenser part (1) has one or preferably more sprinkling holes (6) or a slot, in order to ensure that the powdered soap is sprinkled uniformly over a large surface area.

The apportioning closure pistons (11) seated on the apportioning lever (4) correspond, in terms of number and shape, to the sprinkling holes (6) provided in the dispenser part (1). It is also possible for the apportioning closure piston (11) to be of tongue form (17) and, accordingly, for the sprinkling hole (6) to be formed as a slot.

According to the invention, the external dimension of the apportioning closure piston (11) or (17) is smaller than the internal dimension of the sprinkling holes (6) by such an extent that the powdered soap which is to be apportioned just blocks as a result of its internal friction and does not fall through the gap, the gap being of different sizes depending on the consistency of the powdered soap.

When the dispenser is actuated by pushing on the surface (10) of the apportioning lever (4), the apportioning closure piston (11) moves downwards, and by virtue of adherence, transports powdered soap which, outside the sprinkling hole (6), can fall downwards out of the container.

The surfaces of the apportioning closure piston (11) and of the sprinkling holes (6) are advantageously roughened, in order to achieve the necessary adherence.

The quantity of powdered soap which is to be apportioned is predetermined by the gap width. In this case, the gap width is preferably determined by tests. Furthermore, the quantity of soap which is to be dispensed is decisively influenced by the length of travel of the apportioning closure pistons (11), as well as the shape, size and number thereof.

In order to keep the gap between the sprinkling hole (6) and apportioning closure piston (11) uniform all the way around, a centring shaping of the apportioning closure pistons is preferred, for example by way of centring webs (18) according to FIG. 11, a triangular shape of the apportioning closure piston (11) in round sprinkling holes (6) or guides at the ends of the apportioning closure piston (11) of tongue-like form (17), as shown clearly in FIG. 10 in particular.

As an additional barrier in the basic position and as a top limiting stop for the apportioning lever (4), the apportioning closure pistons (11) may have a conical closure surface (16) which slopes down obliquely, as illustrated in FIGS. 11 and 14.

In order that the powdered soap can fall freely downwards onto the hand when the dispenser is actuated, the apportioning closure pistons (11) are preferably seated on webs (12) which, at the top, have surfaces which slope down obliquely.

It is possible for the apportioning lever (4) to be mounted rotatably at the front or rear of the container (2) or, alternatively, on the mount (3) and, following actuation as far as an end stop (15), to be moved into the basic position by a restoring spring (5), as is illustrated in FIG. 9, or to be fixed on the mount (3), as is shown in FIG. 12, or on the container (2), as is illustrated in FIGS. 14 and 15, and, following actuation, to be moved into the basic position by inherent resilience.

The apportioning closure pistons (11) have extensions (7) at the top, these extensions projecting into the container (2) and preventing bridge formation of the powdered soap when the dispenser is actuated.

What is claimed is:

1. Powdered-soap dispenser for sprinkling powdered soap onto the hand in an apportioned manner, comprising a dispenser part (1), a container (2) and a mount (3), the dispenser part (1) optionally being integrated in the container (2) or separable therefrom, wherein the dispenser part (1) has at least one sprinkling hole (6), in that the dispenser part (1) has an apportioning lever (4) which has an actuating surface (10) and at least one apportioning closure piston (11), the at least one apportioning closure piston (11) projecting through the at least one sprinkling hole (6) into the interior of the container (2), in that the at least one sprinkling hole (6) is open at the top and closed at the bottom in the basic position of the apportioning lever (4) and, following actuation of the apportioning lever (4), is closed at the top and open at the bottom in the dispensing position, and wherein, in the direction towards the interior of the container (2), the apportioning closure piston (11) has integrally formed on it a web (15) and, following this, a closure part (8) which, on the side located on the web (15), is of spherical or conical shape and, in the dispensing position, closes the at least one sprinkling hole (6) from the inside, and wherein the apportioning lever (4) has an integrally formed restoring spring (5) and the surface of the apportioning closure piston (11) and that of the at least one sprinkling hole (6) are roughened.

2. Powdered-soap dispenser according to claim 1, wherein the actuating surface (10) on the apportioning lever (4) is arranged such that, when the dispenser is actuated by the thumb or fingers of one hand, the powdered soap which is to be apportioned falls onto the palm of the same hand.

3. Powdered-soap dispenser according to claim 1, wherein the diameter of the apportioning closure piston (11) is smaller than the diameter of the at least one sprinkling hole (6), the gap between the apportioning closure piston (11) and the at least one sprinkling hole (6) being so small that, as a result of internal friction in the powdered soap, no powdered soap falls through.

4. Powdered-soap dispenser according to claim 1, wherein an elevation (7) is integrally formed on the closure part (8).

5. Powdered-soap dispenser according to claim 1, wherein the apportioning lever (4) is mounted in an inherently resilient manner on the basic body (1) or on the mount (3) such that it can be rotated at a pivot point (9).

6. Powdered-soap dispenser according to claim 1, wherein as the mount (3), standing feet (14) are integrally formed on the basic body (1).

7. Powdered-soap dispenser according to claim 1, wherein the mount (3) is of L-shaped design.

8. Powdered-soap dispenser according to claim 1, wherein the at least one apportioning closure piston (11) is seated on web (12) which is integrally formed on the apportioning lever (4) and has surfaces which slope down obliquely.

9. Powdered-soap dispenser for sprinkling powdered soap onto the hand in an apportioned manner, comprising a dispenser part (1), a container (2) and a mount (3), the dispenser part (1) optionally being integrated in the container (2) or separable therefrom, wherein the dispenser part (1) has at least one sprinkling hole (6), the dispenser part (1) has an apportioning lever (4) which has an actuating surface (10) and at least one apportioning closure piston (11), the at least one apportioning closure piston (11) projecting through the at least one sprinkling hole (6) into the interior of the container (2), and wherein the at least one sprinkling hole (6) is open at the top and closed at the bottom in the basic position of the apportioning level (4) and, following actuation of the dispensing lever (4), is closed at the top and open at the bottom in the dispensing position, and wherein the diameter of the apportioning closure piston (11) is smaller than the diameter of the at least one sprinkling hole (6), the gap between the apportioning closure piston (11) and the at least one sprinkling hole (6) being so small that, as a result of internal friction in the powdered soap, no powdered soap falls through, and wherein the apportioning lever (4) has an integrally formed restoring spring (5) and the surface of the apportioning closure piston (11) and that of the at least one sprinkling hole (6) are roughened.

10. Powdered-soap dispenser according to claim 9, wherein a closure surface (16) which slopes down obliquely in conical form is provided all the way around the apportioning closure piston (11), the external dimension at the bottom being greater than the internal dimension of the at least one sprinkling hole (6), and in that, in the basic position, the closure surface (16) butts against the at least one sprinkling hole (6).

11. Powdered-soap dispenser according to claim 9, wherein the apportioning closure piston (11) is formed such that it is centered in the sprinkling hole.

12. Powdered-soap dispenser according to claim 9, wherein the apportioning closure piston (11) is of tongue-like (17) form.

13. Powdered-soap dispenser according to claim 9, wherein the apportioning closure piston (11) has an extension (7) at the top.

* * * * *